United States Patent [19]

Cook et al.

[11] Patent Number: 4,525,917

[45] Date of Patent: Jul. 2, 1985

[54] PROCESS FOR PREPARING RIMMING OR SEMI-KILLED STEEL INGOTS FOR ROLLING INTO SLABS

[75] Inventors: James R. Cook; Thomas R. Dishun, both of Middletown, Ohio

[73] Assignee: Armco Inc., Middletown, Ohio

[21] Appl. No.: 478,451

[22] Filed: Mar. 24, 1983

[51] Int. Cl.[3] ..... B21B 15/00

[52] U.S. Cl. ..... 29/527.7

[58] Field of Search ..... 148/3; 29/527.7, 526.2, 29/526.4; 164/150, 154

[56] References Cited

U.S. PATENT DOCUMENTS 3,753,288 8/1973 Orbon, Sr. ..... 29/527.7

FOREIGN PATENT DOCUMENTS 49225 11/1978 Japan .
38960 10/1980 Japan .
23306 3/1981 Japan ..... 29/527.7
87945 11/1982 Japan .

OTHER PUBLICATIONS

"Minimization of Fuel Consumption in Soaking Pits . . . ", Cook et al., AIME, Mar. 28-31, 1982, pp. 122-133.
"Liquid Centre and Hot Centre Rolling of Ingots . . . ", Cook et al., ISA, Oct. 18-21, 1982, pp. 235-249.
"CEM TM -Cylindrical Equivalent Model" published by Process Control and Automation Inc., Tech. Report 82-009-1, 1982.

*Primary Examiner*—Howard N. Goldberg
*Assistant Examiner*—Timothy V. Eley
*Attorney, Agent, or Firm*—Frost & Jacobs

[57] ABSTRACT

A process of rolling rimming or semi-killed steel ingots to slabs, comprising removing an ingot from its mold before solidification of the center of the ingot; charging the ingot to a soaking pit and closing the pit; holding the ingot in the pit for the minimum time required to reach a condition wherein more than 85% of the ingot is solidified, the outer rim attains a temperature up to about 525 Fahrenheit degrees cooler than the ingot center and the remainder reaches a temperature at least as high as the desired rolling temperature; and rolling the ingot into a slab. Improved yield, metallurgical quality and minimum energy consumption are achieved.

13 Claims, 3 Drawing Figures

PROCESS FOR PREPARING RIMMING OR SEMI-KILLED STEEL INGOTS FOR ROLLING INTO SLABS

BACKGROUND OF THE INVENTION

This invention relates to processing of ingots from pouring into molds through attainment of a ready-to-roll condition by a method which provides minimum energy requirements, minimum residence time in a soaking pit, improved yield and improved metallurgical quality. A mathematical model of the thermal behavior of ingots may be used to monitor the removal of ingots from molds ("stripping") and charging of ingots into a soaking pit, which may be combined with information from the soaking pit and knowledge of proposed rolling requirements, in order to control the operation of the soaking pit. The principal objectives of the process of the invention include:

retention of a specified amount of residual heat in rimming and semi-killed steel ingots throughout the soaking stage;

utilization of information on ingot strip time and charge time (to the soaking pit) and information from the soaking pit to determine if and the time at which to start heating or "firing" the soaking pit in such a manner as to provide minimum residence time in the soaking pit;

avoidance of metallurgical problems incident to slow solidification times; and utilization of information from soaking and reheating stages to update the projection of ready-to-roll condition if conditions change in the soaking pit and to modify soaking pit operations to meet changes in pacing conditions in the slab rolling mill.

The above objectives require a definition of the ready-to-roll condition in terms of percentage of the ingot solidified and thermal gradient or profile through the ingot, for various grades of steel and ingot sizes.

The stripping of ingots and charging thereof to a soaking pit before complete solidification is disclosed in published Japanese application Nos. J 53134-756, J 55130-301, J 56009-005 and J 82052-937.

Background information relating to the present invention is described in the following articles jointly authored by the present inventors:

"Minimization of Fuel Consumption In Soaking Pits Using a Cylindrical Equivalent Model . . . ", J. R. Cook et al, AIME, Mar. 28–31, 1982, pp. 122–133; and "Liquid Centre And Hot Centre Rolling of Ingots Using On-Line Computer Control", J. R. Cook et al, ISA, Oct. 18–21, 1982, pp. 235–249.

A publication by Process Control & Automation Inc., Technical Report No. 82-009-1, entitled "CEM TM Cylindrical Equivalent Model", deals with processing features of the present invention.

Other articles are referenced in the above-mentioned Cook et al articles, including:

"Development of a Computerized System for Predicting the Progress of Soaking in a Soaking Pit", M. Hinami et al, The Sumitomo Search, No. 13, May 1975, pp 1–7;

"Spherical Ingot Model and its Application to Control of Soaking Pit", E. J. Longwell et al, PLAIC Report 76, 1976; and "On the Rolling of Rimmed Steel Ingots in an Unsolidified State", J. Nogaki et al, Sumitomo Metal Ind. Ltd., 1980.

SUMMARY OF THE INVENTION

The term "solidified outer rim of sufficient thickness to maintain the original shape of the ingot" is used to indicate a condition wherein about 35% of the volume of the ingot has solidified, and does not relate to the rimming zone in a rimmed steel ingot.

According to the invention there is provided a method of rolling rimming or semi-killed steel ingots to slabs with minimum fuel consumption, improved yield and optimum metallurgical quality, comprising the steps of:

removing an ingot from its mold before solidification of the center of said ingot but after formation of a solidified outer rim of sufficient thickness to maintain the original shape of said ingot during mechanical stripping;

charging said ingot to a soaking pit and closing said soaking pit;

determining if heating of said soaking pit, after a predetermined lapse of time is required;

holding said ingot in said soaking pit for the minimum time required to reach a condition wherein more than 85% of the ingot is solidified, the outer rim of said ingot attains a temperature up to about 525 Fahrenheit degrees cooler than said ingot center and the remainder of said ingot attains a temperature at least as high as the rolling temperature desired for the particular grade of steel; and rolling said ingot into a slab. Preferably, the ingot is rolled into a slab before its center has solidified.

As indicated above a definition of the ready-to-roll condition has been developed for practice of the process of the present invention. It has been found that metallurgical quality would be satisfied if each ingot meets the following specifications which define the ready-to-roll condition:

greater than 85% solidified;

a minimum average temperature in the solidified portion;

and a minimum gradient/or minimum temperature at any calculated point in the ingot.

The gradient specification does not limit the maximum temperature of an ingot but does require that it be at least as hot as the minimum specified temperature. It should further be understood that the specific values differ for each hardness grade of steel in order to ensure rollability and to avoid possible damage to the slabbing mill.

In the practice of the present invention yield is improved because overrolling losses induced by slabbing are reduced by slabbing ingots with relatively hot centers. Yield is also improved by decreasing scale jacket thickness due to a decrease in residence time. Decreasing time also improves metallurgical quality.

DETAILED DESCRIPTION

By way of background, steel to be processed as ingots is poured or teemed into cast iron molds and allowed to cool. Teeming temperatures are in the range of 2800° to 2915° F. (1540° to 1600° C.), and the molds may range from ambient to substantially higher temperatures. After a sufficient hold time to permit at least partial solidification ingots are removed or stripped from the mold, the hold time for rimming or semi-killed steel being determined by the ability of the ingots to withstand the stripping process. Ordinarily the stripped ingots are then charged into soaking pits and heated to achieve a suitable thermal profile for rolling into slabs. In some instances it may be necessary to allow the ingots to cool for later processing.

It should be understood that some residence time in a soaking pit is needed for temperature equalization.

If ingots are charged to a soaking pit with sufficient thermal content, it is possible to operate the soaking pit in a "soaking mode" in which additional energy is needed only to overcome the heat losses from the pit. On the other hand, if ingots undergo a lengthy hold time before charging into a soaking pit a "reheating mode" is required in order to bring all parts of the ingot up to a temperature sufficiently high to permit rolling into slabs.

Figure 1:
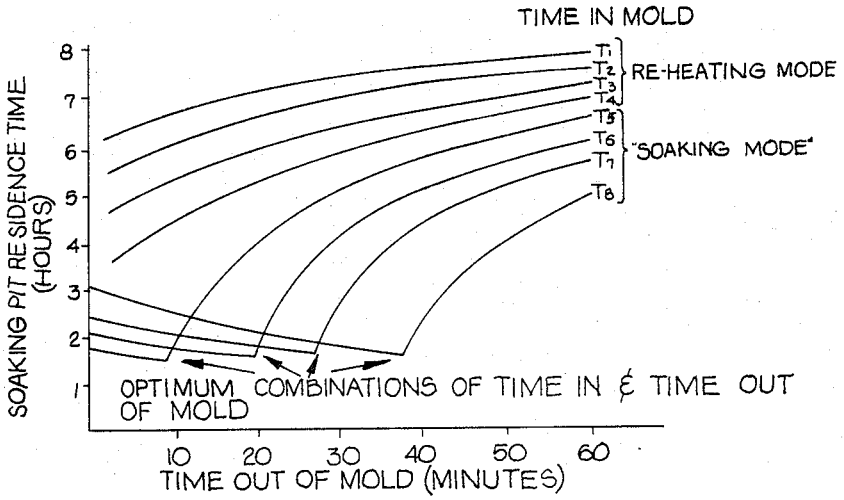
FIG. 1 is a graphic comparison of soaking pit residence time with time in and time out of an ingot mold for a 40 inch×63 inch rimming steel ingot.

Reference is made to FIG. 1 which compares times of a magnitude which would constitute a "reheating mode" with times which would permit a "soaking mode". In FIG. 1, the total time involved, referred to as track time, is the sum of the time interval between pouring or teeming an ingot and the time it is removed or stripped from its mold, designated as time in mold; and the time interval between stripping and charging to a soaking pit, designated as time out of mold. In FIG. 1 T1 is greater than T2 and each succeeding time is shorter, with T8 being the shortest. It will be evident from FIG. 1 that long track times approach a relatively constant soak time of about 7 to 8 hours or longer dependent on soaking pit strategy. Under these circumstances the soaking pit must be operated as a reheating furnace, and the energy requirements are substantial both for reheating the ingots and overcoming heat losses from the pit.

On the other hand, for shorter times in the mold such as T5 through T8, the soaking pit residence time is substantially reduced and is strongly influenced by the time out of mold. It is significant that the curves are of a different characteristic in the soaking mode, and a "knee" develops, these knees representing the optimum combination of time in and out of the mold, which result in minimum soaking pit residence times. In the specific ingot size plotted in FIG. 1 the optimum soaking pit residence times range from about 1.5 to 2 hours. For even larger sizes, optimum times could range up to about 2.5 hours.

By way of specific example, for the given strip time T8, the optimum time out of mold at the knee of the curve is about 38 minutes. This intersects the Y-axis of FIG. 1 at about 1.8 hours. If the time out of mold for strip time T8 is on the order of about 10 minutes, the pit residence time is increased to about 2.5 hours. Thus, even though the ingot is at a higher temperature when charged into the pit a longer holding time is required, since the ingot must be cooled to adequately solidify before it can be rolled.

At the other extreme of the soaking mode, for the longer strip time T5 the optimum time out of mold is about 10 minutes, and this corresponds to a soaking pit residence time of about 1.5 hours.

It is therefore evident that in the soaking mode time in mold exceeds time out of mold, and the pit residence time is a strong function of time out of mold. The penalty for early charge is not as great as that for a late charge. The earlier charge times provide potential benefits in terms of improved yield and energy savings at the expense of slightly longer pit residence times. The increase in soak time for track times shorter than the optimum is due to a slow-down in the solidification process, and this increase in solidification time could result in metallurgical problems if unduly prolonged. However, pit residence times up to 3.5 hours would avoid possible metallurgical problems.

While FIG. 1 illustrates the benefits to be derived from operating within the soaking mode, from the standpoint of minimum energy requirements and minimum soaking residence time, it does not deal with the time at which heating or firing of the soaking pit should be started, if found to be needed, which is also a feature of the present invention.

In order to determine soaking pit firing policy, a model of ingot thermal behavior between teeming and slabbing has been developed to predict the location of the solidification front in an ingot.

Figure 2:
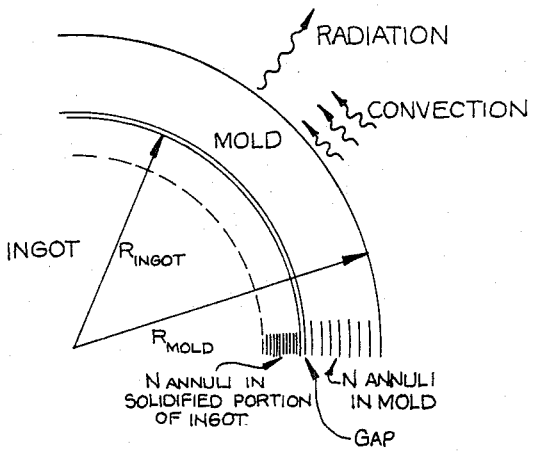
FIG. 2 is a diagrammatic illustration of a cylindrical equivalent ingot utilized as a one-dimensional model for prediction of movement of the solidifying front in an ingot.

Referring to FIG. 2, a cylindrical equivalent ingot is diagrammatically shown which retains the surface to volume ratio of the real ingot by requiring that the surface area of the cylindrical equivalent ingot equal the surface area of the real ingot and the mass of the cylindrical equivalent ingot equal the mass of a real ingot. An annular net may be constructed mathematically in the solidifying portion of the ingot and in the mold. Heat transfer between nodes and with the external environment are in accordance with conventional heat transfer equations. As the cylindrical equivalent ingot cools and solidifies, the movement of the solidifying front is controlled by the latent heat contribution of the solidifying material. The model algorithm permits the annular net to expand in order to follow the solidifying front.

A number of assumptions have been used in the development of a cylindrical equivalent model, which are set forth in the above-mentioned Cook et al article, AIME, Mar. 28–31, 1982, at pages 125–126. These are as follows:

the radius of the cylindrically equivalent ingot is chosen to preserve the surface/volume ratio between model and real ingot;

the equivalent mold thicknesses can be computed from mold weights;

the lengths of equivalent mold and ingot are computed from the nominal ingot sizes and include pour heights;

the ingot cooling and reheating processes are modelled by defining two sets of uniformly spaced annuli within the mold and the solid portion of the ingot; these annuli are isotherms and move with the solidifying front as cooling and solidification proceed;

teeming occurs instantaneously with the liquid steel at a single uniform temperature;

initially the ingot is 99% liquid with a 1% (by radius shell of solid material concentric with but separated from the surrounding mold by a small gap;

the latent heat of solidification evolves isothermally;

liquid steel convection currents can be neglected;

variations in density, volume contraction with cooling, and the influence of segregation can be neglected;

heat loss from the ingot is predominantly to the mold, and losses from the top and bottom can be ignored;

heat transfer between the solidifying ingot and surrounding mold is entirely by radiation across a small gap;

the initial mold temperature is artibrary (solidification time depends very weakly on mold temperature);

the mold cools by convection and radiation to the ambient temperature;

conventional values of density, specific heat, and thermal conductivity, with associated temperature dependences are used;

heat transfer mechanisms can be tested by adjusting physical constants within reasonable bounds to agree with actual data;

in the absence of sufficiently detailed plant data, published results can provide considerable guidance to overall behavior;

solidification is complete when the ingot is 95% (by radius) solidified;

after stripping the mold is removed from the problem, but the ingot continues to cool by convection and radiation to ambient;

the soaking process is simulated by setting the ambient temperature of the model ingot to the soaking pit temperature;

the soaking process is simulated using calculated view factors and furnace temperatures; variations in the number of ingots charged to a pit are accomodated; the details of the actual furnace heat transport mechanisms are ignored but variations in pit operations are detected; (view factor ranges between 0.30 and 0.85 and is a measure of rate of heat transfer from an ingot to a pit or vice versa, i.e. radiation interchange between pit and ingot);

in projecting ingot thermal behavior, the furnace temperature profiles are generalized to either a linear ramp followed by several steps, or to a smooth curve projected from pit temperature data;

ingots are considered ready-to-roll if the average temperature is above a specified rolling temperature and the ingot is uniform in temperature within a specified limit determined from metallurgical and yield considerations.

for most grades these ready-to-roll definitions can be interpreted as an average and a minimum temperature specification for the model ingot.

In a preferred embodiment of the process of the present invention when conducted with the aid of a computer, the above-described model of ingot thermal behavior between teeming and slabbing is utilized. A computer is used to inform a traffic coordinator in expediting transportation of ingots through the casting, stripping, soaking and slab mill system. Provision may also be made for manual confirmation of traffic movement detected by track sensors. Such an ingot processing system includes two major subsystems, the first of which monitors the ingot processing area between a melt shop and soaking pit, tracking the flow of material through the system, retaining information on individual ingots and molds, and providing the traffic coordinator with information and guidance in expediting transportation; while the second subsystem monitors and controls soaking pits. Each subsystem communicates with the other and preferably is also in communication with higher levels in a hierarchy of process control computers. The cylindrical equivalent model thus provides a concise mathematical representation of ingot thermal profiles between teeming and charging into a soaking pit, a consistent method of determining the best available options in meeting slab mill scheduling requirements, a means of predicting ingot rollability using information from a soaking pit after firing has begun, and a method for determing how such firing should be modified to comply better with actual slab mill demand.

The cylindrical equivalent model used in the preferred practice of the process of the present invention is dependent for its effectiveness on the accuracy and availability of information for each ingot on the time of teeming, the time of stripping, and the time of charging to the soaking pit. In connection with charging, the finish charge time may be defined as the time when the soaking pit is covered after charging. Additional information utilized in the cylindrical equivalent model includes soaking pit wall temperature, number of other ingots in the soaking pit, ingot size and grade, fuel rate and type, air/fuel ratio and the like, from which guidance may be provided to a dispatcher or traffic coordinator at each stage in the processing, and to a heater whenever a soaking pit is predicted to be available for charging.

Tests have established that for a 40 inch×63 inch ingot size about 35% solidification is needed to reach a condition wherein the solidified outer rim is of sufficient thickness to maintain the original shape of the ingot when it is stripped from its mold. The percent solidification at which ingots safely can be stripped varies somewhat with ingot size, but it is believed that about 50% solidification represents a safe limit.

Tests also confirmed that optimum results from the standpoint of rollability and quality of the slab were obtained when from about 3 to 7% of the ingot center remains molten when rolled and the outer rim is about 400 Fahrenheit degrees cooler than the molten center. Slabs were experimentally slabbed with a 15% molten center, and it was found that distortions and bubbles appeared in the slabs. A maximum of about 10% can remain molten.

In some situations, because of slab mill delays, extended time in molds and/or unavailability of a slab mill, ingot centers will have solidified completely. Nevertheless, if the ingots have retained sufficient internal heat to keep the centers substantially hotter than the outer rim, improvements in yield, quality, and particularly in energy savings are still obtained in comparison to the prior art practice.

Figure 3:
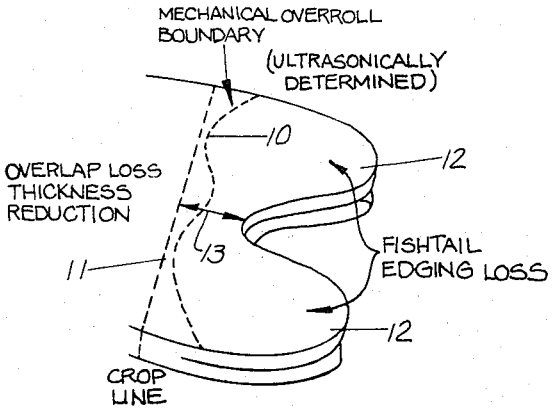
FIG. 3 is a diagrammatic illustration of the end of a slab after slabbing indicating portions which must be cropped.

Reference is made to FIG. 3, which is a diagrammatic illustration of the end of a rolled slab in conventional practice. As is well known to those skilled in the art, it is necessary to remove the material at the end of a rolled slab which is overrolled, the overroll boundary being shown in FIG. 3 by the dashed line 10. Removal is effected by cropping along the dashed line 11, and the removed material is of course unuseable. This is thus referred to as cropping loss.

As shown in FIG. 3 total crop loss is the sum of fishtail loss shown at 12 which results from edging, and overlap loss shown at 13, caused by thickness reduction. It is necessary to have some edging, but if this is restricted to an optimum to avoid insufficient as well as excessive edged conditions, cropping loss is also minimized. The timing of the edging operation is important and can significantly influence yield. It has been found that the rolling of ingots while about 5% of the center is still molten, in accordance with the present invention, minimizes cropping loss. An improvement in yield resulting from this reduction in cropping loss has been found to be on the order of 1% to 3% in the practice of the present invention.

From the standpoint of energy requirements, the method of the invention has resulted in fuel savings of at least about 70% in soaking pit operation and can be as high as 100% if no firing is required.

EXAMPLE 1

A 200 ton charge of molten rimming steel was teemed into ingots 40 inches×63 inches×96 inches high. The desired rolling temperature for this grade steel was 2370° F.

Computer operation was as follows:

input ingot nominal width 63 inches (computer supplies ingot width, height & mold weight)
input time in mold in minutes 120
input time out of mold in minutes 35
input type of steel, (rimming or semi-killed)
input ambient temperature 70° F.
enter time delay to start fire in minutes 15
input initial pit temperature 1800° F. (at charge)
input first pit set point temperature 2440° F.
input time in minutes to reach set point 25 minutes
enter view factor 0.7
0.501 fraction solidified at time=107.364
stripped at time 120.9 minutes
time increment 67.64 seconds
iteration=1348 (in mold)
moving front radius 10.771 inches
fraction solidified 0.541

| INGOT | | MOLD | |
|---|---|---|---|
| RADIUS | TEMPERATURES °F. | RADIUS | TEMPERATURES °F. |
| 10.7713 | 2750.0000 | 23.4874 | 1293.9150 |
| 12.8907 | 2585.1484 | 25.2773 | 1165.6067 |
| 15.0100 | 2416.4487 | 27.0672 | 1054.4875 |
| 17.1293 | 2243.7700 | 28.8571 | 961.5560 |
| 19.2487 | 2068.6440 | 30.6470 | 887.1721 |
| 21.3680 | 1893.7605 | 32.4369 | 830.9843 |
| 23.4874 | 1722.5667 | 34.2268 | 791.8992 |
| charged at | | | |
| time = 156.7 minutes | | | |
| time increment = 197.08 seconds | | | |
| iteration = 14 (mold removed, cooling in air) | | | |
| moving front radius 8.365 inches | | | |
| fraction solidified .644 | | | |

| RADIUS | TEMPERATURES °F. |
|---|---|
| 8.3649 | 2750.0000 |
| 10.8853 | 2555.3931 |
| 13.4057 | 2357.3184 |
| 15.9261 | 2147.9536 |
| 18.4466 | 1924.0608 |
| 20.9670 | 1686.6255 |
| 23.4874 | 1440.8279 |
| ambient temperature 70° F. | |
| furnace ramp parameters: initial 1800° F. final 2440° F. | |
| time to reach set point 25.0 minutes | |
| ingots 95% solidifed at time 116.7 minutes | |
| 1.1132 | 2750.0000 |
| 4.8423 | 2574.3418 |
| 8.5713 | 2476.2891 |
| 12.3003 | 2416.3589 |
| 16.0293 | 2390.9946 |
| 19.7584 | 2395.9673 |
| 23.4874 | 2421.0513 |

Additional examples of the process of the invention and comparative examples of processes outside the invention are set forth in the appended Table.

TABLE

40" × 63" Ingots - Low Carbon Grade Steel
Rolling Temp. 2370° F.

| Example | Time In Mold (min) | Time Out Of Mold | Pit Temp. °F. | Delay Fire Pit | Fire Delay Time (min.) | Firing Duration (min.) | Residence Time (min.) | ΔT-Surface To Minimum Interior Temp. | % Molten Center |
|---|---|---|---|---|---|---|---|---|---|
| 2* | 120 | 35 | 1800 | yes | 25 | 25 | 114 | 49 | 5 |
| 3* | 120 | 35 | 1800 | yes | 20 | 25 | 114 | 40 | 5 |
| 4 | 117 | 25 | 1800 | no | — | — | 89 | 17 | 17 (N.R.) |
| 5 | 117 | 25 | 1800 | yes | 32 | 57 | 89 | 72 | 15 (N.R.) |
| 6 | 117 | 25 | 1800 | no | — | — | 89 | 49 | 16 (N.R.) |
| 7* | 117 | 25 | 1800 | no | — | — | 139 | 5 | 5 |
| 8* | 117 | 25 | 1800 | no | — | — | 120 | 17 | 9.5 |

*Process of the invention
N.R. Not rollable

We claim:

1. A process of rolling rimming or semi-killed steel ingots to slabs with minimum energy consumption, improved yield and optimum metallurgical quality, comprising the steps of:

providing a model to determine projected ingot thermal profile and time at which an ingot is ready to roll on the basis of at least ingot size, time of the ingot in its mold, and initial soaking pit temperature;

removing said ingot from its mold before solidification of the center of said ingot but after formation of a solidified outer rim of sufficient thickness to maintain the original shape of said ingot;

charging said ingot to a soaking pit and closing said pit;

determining from said model if heating of said soaking pit, after a predetermined lapse of time, is required before attaining a ready-to-roll condition;

holding said ingot in said soaking pit for the minimum time required to reach a condition wherein more than 85% of the ingot is solidified;

removing said ingot from said soaking pit when the outer rim of said ingot attains a temperature up to about 525 Fahrenheit degrees cooler than said ingot center and the remainder of said ingot attains a temperature at least as high as the rolling temperature desired for the particular grade of steel; and rolling said ingot into a slab.

2. The process of claim 1, including the step of heating said soaking pit after a predetermined lapse of time dependent upon the length of time said ingot is in its mold and the length of time said ingot is out of said mold prior to charging into said pit.

3. The process of claim 1, wherein said ingot is rolled into a slab before said ingot center has solidified.

4. The process of claim 3, wherein said ingot is rolled into a slab when about 93% to about 97% of said ingot is solidified.

5. The process of claim 1, wherein said thermal profile at the time said ingot is ready to roll ranges from about 2370° to about 2750° F. for a desired rolling temperature of about 2370° F. for a low carbon grade steel.

6. The process of claim 1, wherein said initial soaking pit temperature is about 1800° F., and including the step of heating said soaking pit to a temperature of about 2380° to about 2480° F. for a low carbon grade steel ingot.

7. The process of claim 1, wherein the residence time of said ingot in said soaking pit is in accordance with the soaking mode curves plotted in FIG. 1 herein.

8. The process of claim 1, wherein said ingot is removed from its mold when up to about 50% of said ingot is solidified.

9. A process of preparing ingots of rimming or semi-killed steel for rolling into slabs with the help of a digital computer, comprising the steps of:

providing the computer with a mathematical model of the thermal behavior of ingots between pouring and a ready to roll condition, including at least ingot size, grade of steel, number of ingots in a soaking pit, time of the ingot in its mold, time of the ingot out of its mold, and initial soaking pit temperature;

removing said ingot from its mold before solidification of the center of said ingot but after formation of a solidified outer rim of sufficient thickness to maintain the original shape of said ingot;

charging said ingot into said soaking pit and closing said pit;

calculating in said computer if heating of said soaking pit is needed before attaining a ready to roll condition;

calculating in said computer a minimum residence time in said pit at which more than 85% of said ingot has solidified;

removing said ingot from said pit when the outer rim of said ingot attains a temperature up to about 525° F. cooler than the center of said ingot and the remainder of said ingot attains a temperature at least as high as the rolling temperature desired for the particular grade of steel; and rolling said ingot into a slab.

10. The process of claim 9, including the step of heating said soaking pit after a calculated lapse of time dependent upon the length of time said ingot is in its mold and the length of time said ingot is out of said mold prior to charging into said pit.

11. The process of claim 9, wherein said ingot is rolled into a slab before said ingot center has solidified.

12. The process of claim 11, wherein said ingot is rolled into a slab when about 93% to about 97% of said ingot is solidified.

13. The process of claim 9, wherein said ingot is removed from its mold when up to about 50% of said ingot is solidified.

* * * * *